US005672144A

United States Patent [19]

Hulme

[11] Patent Number: 5,672,144

[45] Date of Patent: Sep. 30, 1997

[54] SLANT-BOARD EXERCISING DEVICE

[76] Inventor: Edward M. Hulme, 310 Maple St., Woonsocket, R.I. 02895

[21] Appl. No.: 440,834

[22] Filed: May 15, 1995

[51] Int. Cl.[6] ..... A63B 26/00

[52] U.S. Cl. ..... 482/140; 482/91

[58] Field of Search ..... 482/52, 140

[56] References Cited

U.S. PATENT DOCUMENTS 5,122,107 6/1992 Gardner ..... 482/140
5,158,512 10/1992 Irwin et al. ..... 482/53
5,160,306 11/1992 Lui ..... 482/140
5,269,735 12/1993 Pfitzenmeier ..... 482/52
5,372,566 12/1994 Olschansky et al. ..... 482/140

*Primary Examiner*—Stephen R. Crow
*Attorney, Agent, or Firm*—Robert J. Doherty

[57] ABSTRACT

An exercising article which may be in kit form for converting a step board exercising member into a slant board exercising device by the rearrangement of the separate end supports of the step board member in relationship to the top platform which they support and the addition of a knee restraint adapted for connection to one or both of the end supports.

3 Claims, 6 Drawing Sheets

SLANT-BOARD EXERCISING DEVICE

BACKGROUND AND OBJECTS OF THE INVENTION

This invention relates to a slant board exercising device and particularly a device which uses components of a commercially available step board exercising device such that the step board may be easily and economically converted into a slant board exercise device. As such, the invention takes the form of either a kit in which various components form the slant board device of the present invention or as an accessory by which the known step board-can be converted to the slant board exercising device as above indicated.

Presently both step board and slant board exercise devices exist. Step boards usually take the form of a longitudinally extending platform with a flat upper surface and adapted to extend between and be supported by two end supports which nest or otherwise interlock with each other. Slant board exercise devices are also available and such normally comprise a longitudinally extending board with a flat upper surface on which the exerciser sits and a block on which one end of the board rests such that the board assumes a slanted position to increase the difficulty and benefit obtained from sit ups performed on such slanted board. Alternatively, the end of the slant board can be provided with hooks to grasp an individual bar or a vertically spaced series of such bars as provided at gyms. The above constructions while perfectly adequate for their individual uses require owning and storing two separate pieces of exercise equipment.

Accordingly, an object of the present invention is to provide a kit or accessory in which a standard or conventional step board exercise device can be easily and inexpensively converted into a slant board exercise device.

A further object of the present invention is the provision of a kit or conversion device in which various levels of difficulty in the sit up level performed on such slant board is achieved while only utilizing the component parts of the step board and conversion implement of the present invention. Accordingly as the exerciser progresses, he or she may perform sit up exercises at either a level position, a moderately inclined position or a more steeply inclined position—all with the same equipment.

These and other objects of the present invention are achieved by an exercising device consisting of a step board and knee restraint, said step board in turn comprising a pair of separate end supports adapted for longitudinal spacing from each other and a platform adapted for support by said supports and in turn adapted for longitudinally spanning the space between said supports, said knee restraint having opposed first and second ends with said first end including means for attachment to at least one of said end supports and the second end having means for simultaneously contacting upper surface portions of the exerciser's lower thighs when the exerciser is downwardly reclined upon said platform with said platform in turn supported at one end thereof by one or both of said end supports in superposed relationship to each other.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 4:
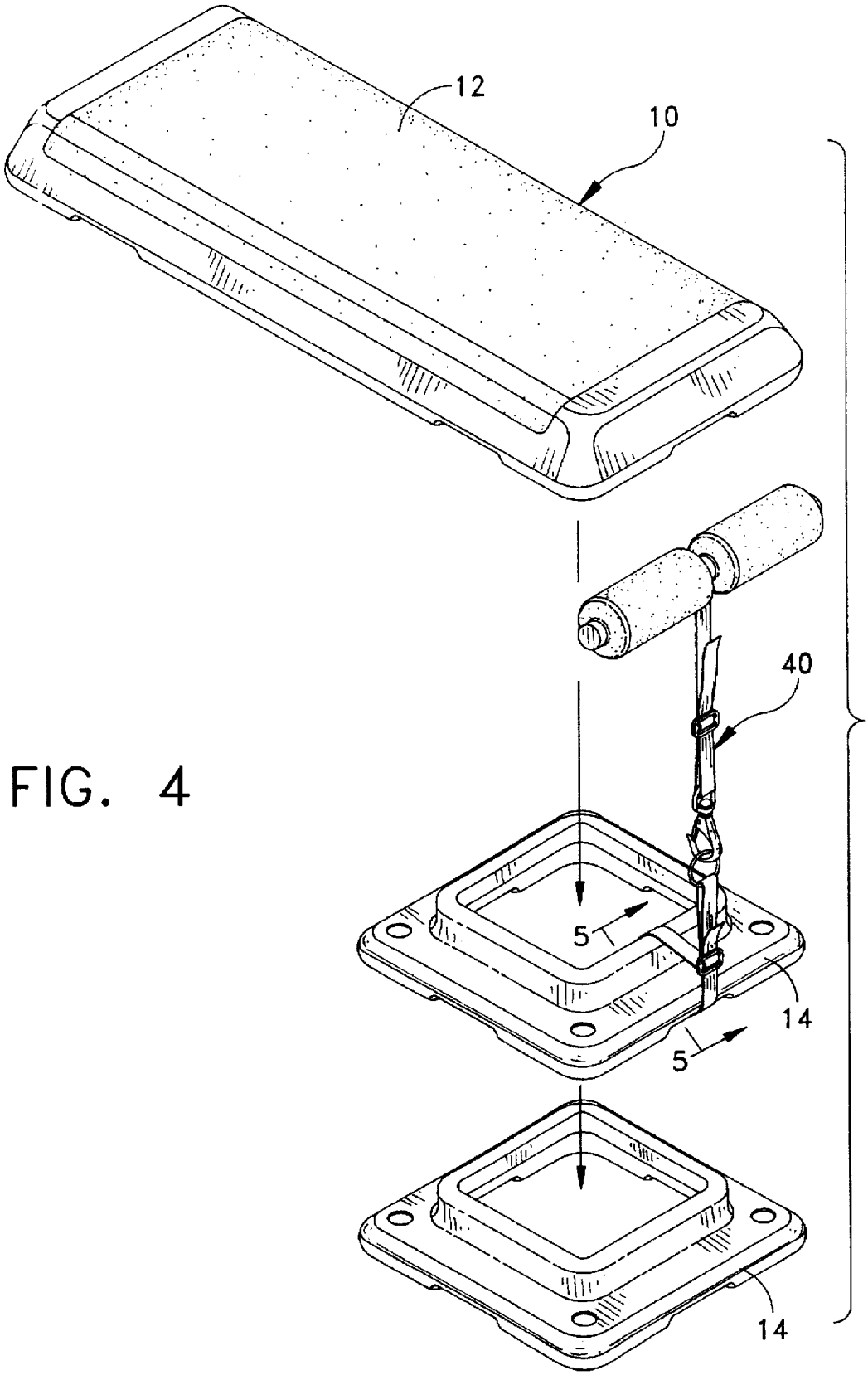
FIG. 4 is an exploded perspective view showing the various components shown in FIG. 2.
Figure 6:
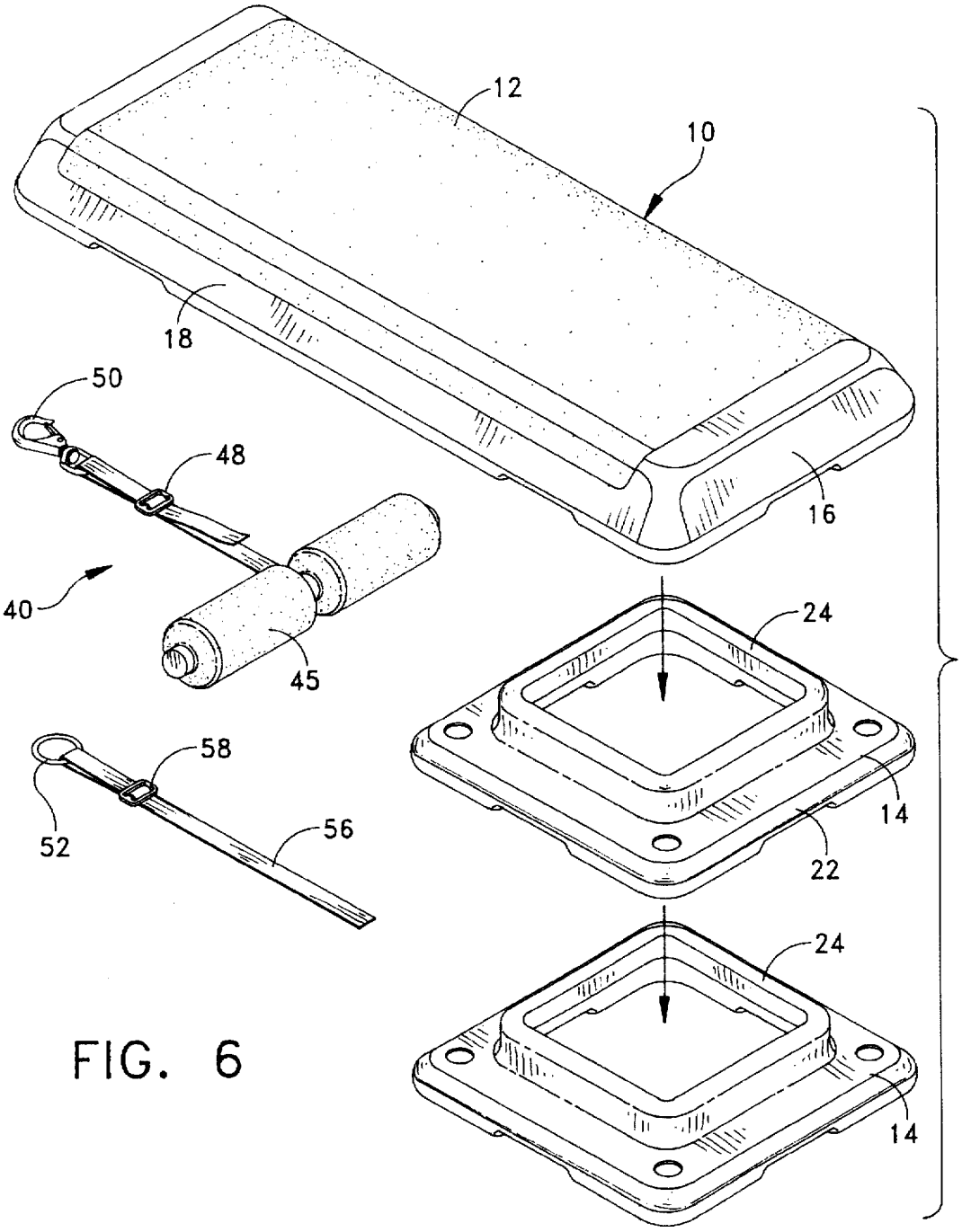
FIG. 6 is an exploded perspective view similar to FIG. 4.
Figure 7:
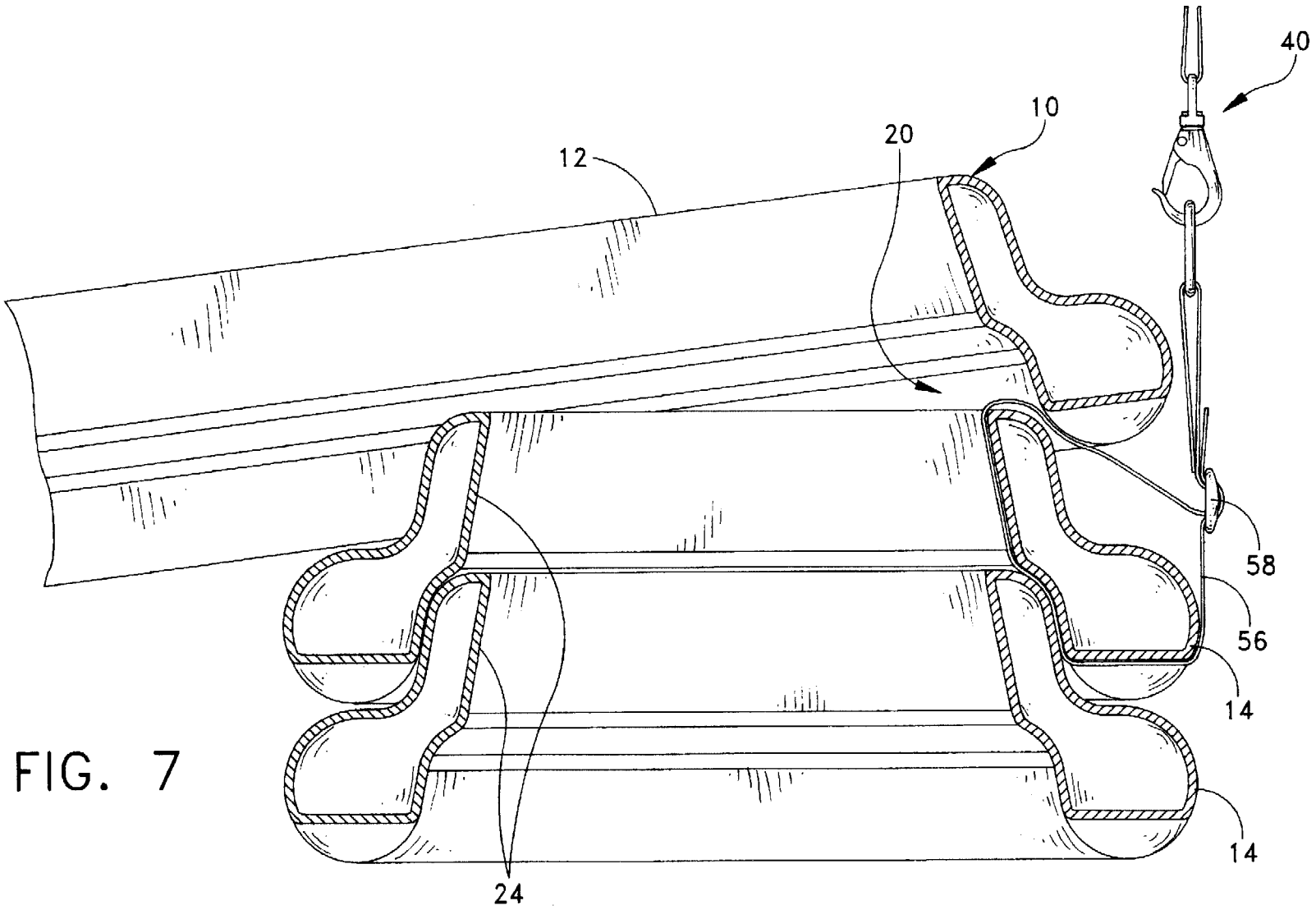
FIG. 7 is a partial sectional view through FIG. 2 showing the manner in which the end support and step board platform interlock to form an inclined surface on which sit up exercises may be performed in accordance with the present invention.

Turning now to the drawings and particularly FIGS. 4, 6 and 7 thereof, a presently commercially available step board device is depicted by its component parts. Thus, for example, as shown in FIGS. 6 and 7, the step board 10 includes a top platform 12 and a pair of end supports 14 adapted to be placed in spaced longitudinal relationship at each end of the platform to support such platform a few inches off the floor and in a position parallel thereto. This would be the position utilized when this device is used for its indicated purpose—that of a step board in which the exerciser steps up onto the platform and then back down therefrom performing aerobic exercises in such manner. The platform 12 is of overall elongated configuration and preferably formed from some plastic resinous material and includes a flat top surface 14 which may include a tread or wear resistant material and downwardly extending end and side walls 16, 18 respectively which cooperatively form end pockets 20 at each end of the slant board 12 and at the underside thereof and into which the end supports 14 interfit.

The end supports 14 each include a body including a base 22 generally of flat rectangular shape and an upwardly extending peripheral wall 24 forming a central boss. The boss 24 has no top surface and, in effect, thus reduces the amount of plastic from which it is produced and forms a convenient handle by which the end supports 14 may be grasped and transported.

Normally, the step board is utilized with the two end supports 14 spaced longitudinally from each other and the platform 10 extending there across so that the platform is supported in a level position by each of the supports 14 at a desirable distance of a few inches from the supporting floor on which it rest. Such a device is commercially available under the name THE STEP. The relationship with regard to the interfitment of the bosses 24 with the pockets 20 is best shown by FIG. 7.

Figure 5:
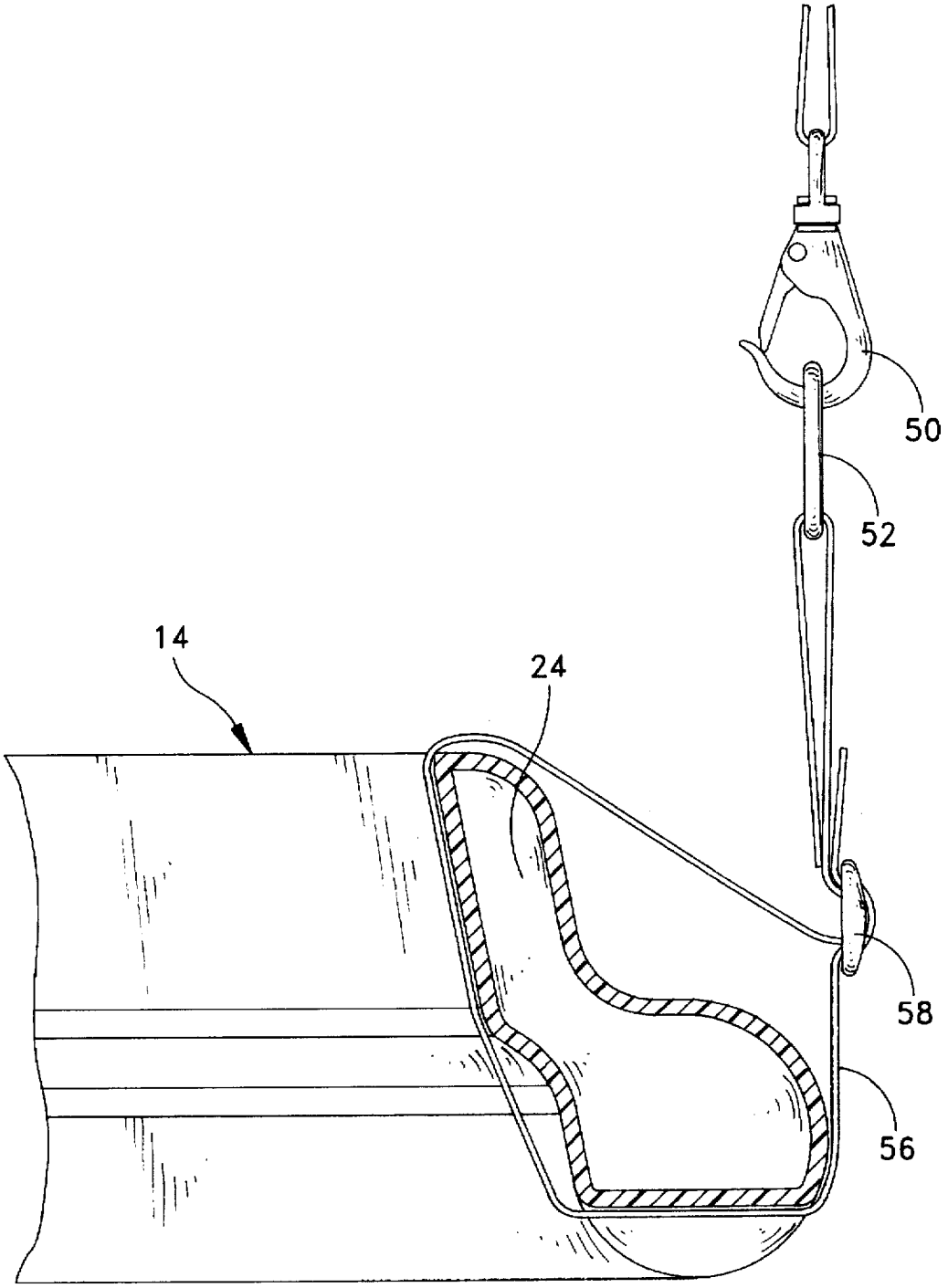
FIG. 5 is a partial side elevational view showing the manner in which the knee restraint accessory of the present invention preferably attaches to one of the end support components of the step board.

In order to convert the aforementioned step board exercising device into a slant board exercising device, the knee restraint 40 of the present invention is provided. Such includes an elongated central portion 42 which may be of one-piece or multiple-piece construction and terminates at its upper end in a transversely extending bar 44 preferably covered with a rubber or fabric roll 45 which is cut away of the central section 46 such that the upper portion of the strap 47 may be affixed thereto preferably permanently as by a loop (not shown) with the loop end sewn to a proximal body portion of the strap 47. The lower portion of the strap 46 is looped around and secured by a buckle 48 and serves to attach a snap fastener 50 of known construction thereto. The snap fastener 50 in turn is adapted to engage a hook 52 which in turn may be loop fastened to a lower strap 56 by sewing as shown in FIG. 5 and as referred to with regard to strap 47. The lower strap 56 terminates in an open end which is adapted to loop around the body of one of the end supports 14 as particularly shown in FIG. 5 and secured by the buckle 58.

Figure 1:
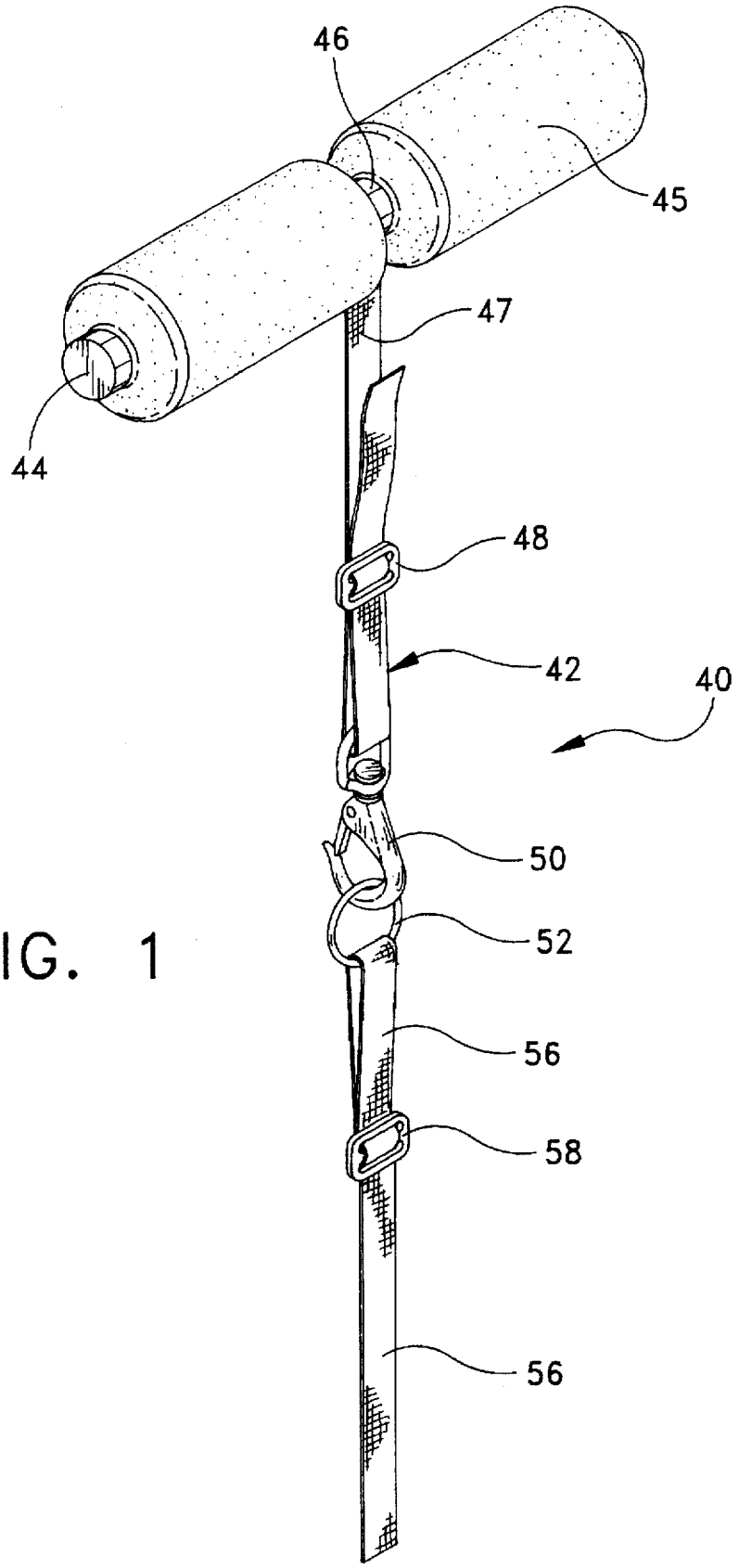
FIG. 1 is a perspective view of the preferred form of knee restraint of the present invention whereby the step board device can be converted into a slant board exercising device.
Figure 2:
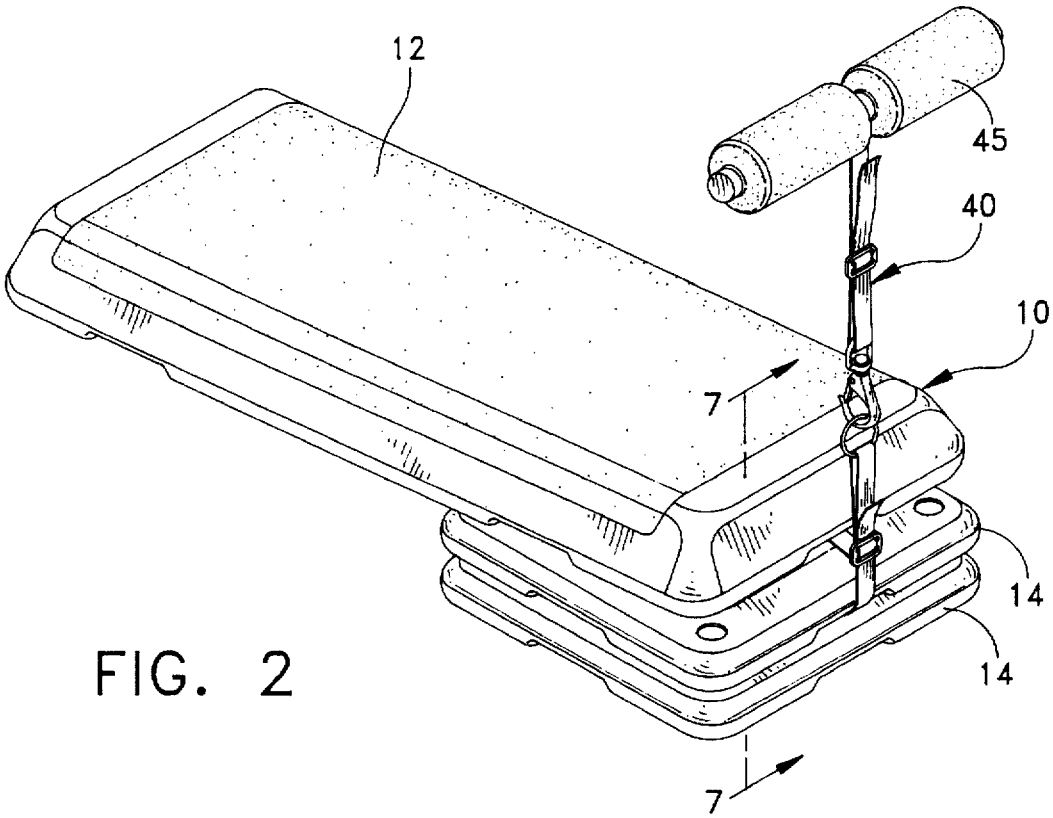
FIG. 2 is a perspective view showing the assembled form of the slant board device in its most inclined position.
Figure 3:
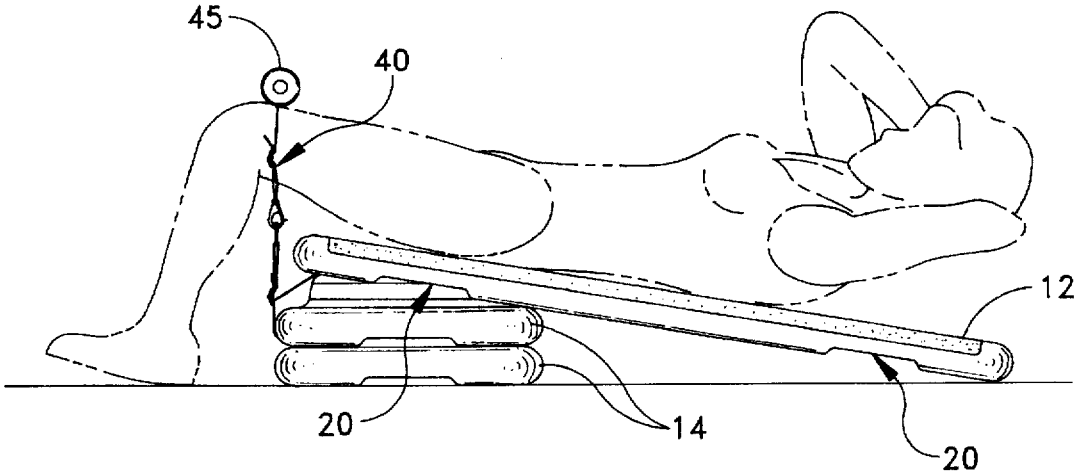
FIG. 3 is a side elevational view thereof showing an exerciser performing sit ups thereon.

In utilizing the knee restraint 40 along with the step exercising device components, there are three alternate positions that may be utilized as previously referred to: 1) the position in which the platform is supported by an end support 14 at either end thereof and, accordingly, is parallel to the floor or other supporting surface; 2) the situation in which one end support is removed and the other end support supports the platform in a slightly inclined position; and 3) the most inclined position as shown in the drawings wherein both end supports 14 are utilized at one end of the platform so as to produce a more highly inclined slant board position thereon. In such most inclined position illustrated and in the other two positions as previously mentioned, the knee restraint lower end is looped about one or even both of the end supports 14 to form a lower end attachment thereof. The other strap end, that is, the upper strap portion 46, extends between the exercise's knees such that the roll or rolls 45 are positioned on top of the user's thighs to restrain the knees and the lower leg portions from rising up while performing the exercises, namely, sit ups, in the position shown in FIG. 3. Thus by appropriate manipulation of the buckles 48 and 58, the vertical distance between the rolls 46 and attachment point of the knee restraint to the slant board either on the upper, lower or both of the end supports 14 may be achieved.

As previously indicated, the upper and lower straps 46, 56 respectively may, in fact, be formed of one-piece construction and achieve the intended purposes of the invention as above indicated—that of conveniently and inexpensively converting a step board exercising device into a slant board sit up device in which case only one buckle would be necessary. However, the construction shown in the drawings enables the knee restraint 40 to be utilized in other situations, for instance, an eye hook screw of known configuration could be screwed into the exercising room floor and then the swivel hook 50 directly attached thereto should it be desired not to utilize the end supports 14 as the means by which the knee restraint is secured or even in those cases where the sit up exercises are performed directly on the floor without the slant board such as the platform 12.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A kit for forming a slant board exercising device consisting of a step board and a knee restraint, said step board in turn comprising a pair of separate end supports adapted for longitudinal spacing from each other and a platform adapted for support by said supports and in turn adapted for longitudinally spanning the space between said supports, said knee restraint having opposed first and second ends with said first end including means for attachment to at least one of said end supports and the second end having means for simultaneously contacting upper surface portions of the exerciser's lower thighs when the exerciser downwardly reclined upon said platform with said platform in turn supported at one end thereof by at least one of said end supports, said platform having a flat upper surface and a lower concave surface including end pockets for receiving the support portions of said end supports, said end supports having upper portions defined by an upstanding boss and said end portions further including lower concave surfaces forming a secondary pocket wherein said end supports interfitted with each other with the boss of the lowermost first end supported extending into and received by the secondary pocket of the second end support positioned thereabove and the boss of the second end support received by the pocket of the step board end proximal thereto wherein both of said end supports are in superposed relationship to each other and in turn support said one end of said platform, said knee restraint including an elongated flexible strap terminating at its upper end in a transversely oriented bar adapted to span the exerciser's lower thighs with the proximal strap portion passing between the exerciser's knees and further including a loop at the lower strap end, said loop encircling a portion of at least one of said end supports which in turn are interfitted with each other and are positioned at said one end of said platform for connection thereto, said loop having the same orientation as said strap and both said loop and said strap having adjustment means for adjusting the loop size and the strap length respectively, said knee restraint being of two-piece construction wherein the bar terminates at the end of one piece and the loop terminates at an end of the other piece and the two pieces are joined centrally by means of a ring and snap fastener.

2. The method of converting a step board exercising member to a slant board exercising device including the provision of an exercising article wherein the step board exercising member is of the type wherein the step board comprises a pair of separate end supports adapted for longitudinal spacing from each other and a platform adapted for support by said supports and in turn adapted for longitudinally spanning the space between said supports and wherein said platform is in turn adapted to be supported at one end thereof by at least one of said end supports and wherein said end supports have upper portions defined by an upstanding boss and said end portions further including lower concave surfaces forming a secondary pocket wherein the boss of said at least one end support may be received by the pocket of the step board end proximal thereto, and wherein the exercising article comprises a knee restraint having opposed first and second ends with said first end including means for attachment to at least one of said end supports and the second end having means for simultaneously contacting upper surface portions of the exerciser's lower thighs when the exerciser is downwardly reclined upon said platform and wherein said knee restraint includes an elongated flexible strap terminating at its upper end in a transversely oriented bar adapted to span the exerciser's lower thighs with the proximal strap portion passing, between the exerciser's knees and further including a loop at the lower strap end, said loop adapted to encircle a portion of at least one of said end supports for connection thereto, said conversion comprising encircling said loop about a portion of at least one of said end supports for connection thereto and thereafter placing said at least one end support beneath one end of the step board only, such that the boss of said end support is received by the pocket of the step board end proximal thereto and the strap upwardly outwardly extends from said proximal end of the step board such that the step board is supported by said end support at one end thereof and solely by the surface on which both the step board and support is supported at the other end so that the step board subsequently assumes a slanted orientation.

3. The method of claim 2, further comprising nesting two of said supports together to form a nested stack and then placing said proximal end of the step board on top of said nested stack so as to increase the resultant incline of said board.

* * * * *